US008419380B2

(12) United States Patent
Ko

(10) Patent No.: US 8,419,380 B2
(45) Date of Patent: Apr. 16, 2013

(54) HERMETIC COMPRESSOR

(75) Inventor: In-Seok Ko, Changwon (KR)

(73) Assignee: LG Electronics Inc., Seoul (KR)

( * ) Notice: Subject to any disclaimer, the term of this patent is extended or adjusted under 35 U.S.C. 154(b) by 288 days.

(21) Appl. No.: 12/866,346

(22) PCT Filed: Feb. 25, 2009

(86) PCT No.: PCT/KR2009/000890
§ 371 (c)(1),
(2), (4) Date: Aug. 5, 2010

(87) PCT Pub. No.: WO2009/110690
PCT Pub. Date: Sep. 11, 2009

(65) Prior Publication Data

US 2010/0322796 A1 Dec. 23, 2010

(30) Foreign Application Priority Data

Mar. 5, 2008 (KR) ..... 10-2008-0020679

(51) Int. Cl.
*F01C 11/00* (2006.01)

(52) U.S. Cl.
USPC ..... 417/250; 417/410.3; 417/516; 417/558; 417/493; 417/503

(58) Field of Classification Search ..... 417/250, 417/410.3, 516, 558, 493, 503, 288, 303; 418/5, 11, 12, 60
See application file for complete search history.

(56) References Cited

U.S. PATENT DOCUMENTS

| | | | | |
|---|---|---|---|---|
| 2,243,466 | A * | 5/1941 | Kucher | 417/250 |
| 3,870,440 | A * | 3/1975 | Zuercher, Jr. | 418/248 |
| 4,826,408 | A | 5/1989 | Inoue et al. | |
| 5,542,831 | A | 8/1996 | Scarfone | |
| 6,447,274 | B1 * | 9/2002 | Horihata et al. | 418/60 |
| 2002/0182096 | A1 * | 12/2002 | Matsumoto et al. | 418/60 |

OTHER PUBLICATIONS

International Search Report issued in PCT/KR2009/000890 dated Jul. 16, 2010.

* cited by examiner

*Primary Examiner* — Charles Freay
*Assistant Examiner* — Christopher Bobish
(74) *Attorney, Agent, or Firm* — Ked & Associates LLP

(57) ABSTRACT

A noise reducing device for a hermetic type compressor is provided that includes a plurality of cylinders disposed at upper and lower portions thereof, a communication path that provides for communication between inlets of the plurality of cylinders, and a suction pipe coupled to an inlet of one of the plurality of cylinders. Such an arrangement may reduce a number of components and simplify the fabrication process. Accordingly, fabrication costs may be reduced, and vibration due to resonation of a plurality of suction pipes may be avoided. Further, such an arrangement may provide enhanced performance by optimizing a specification of the suction pipe and a suction path thereof.

3 Claims, 3 Drawing Sheets

HERMETIC COMPRESSOR

TECHNICAL FIELD

The present invention relates to a hermetic compressor, and more particularly, to a hermetic compressor capable of supplying a refrigerant to a plurality of cylinders by using one suction pipe.

BACKGROUND ART

Generally, a hermetic compressor is provided with a motor part disposed in a hermetic casing for generating a driving force, and a compression part for compressing a refrigerant by receiving a driving force from the motor part.

The hermetic compressor is categorized into a single type one and a dual type one according to the number of cylinders. According to the single type hermetic compressor, one suction pipe is connected to one cylinder. However, according to the dual type hermetic compressor, a plurality of suction pipes are connected to a plurality of cylinders.

DISCLOSURE OF INVENTION

Technical Problem

However, in the case of the dual type hermetic compressor, the number of components and processes is increased as the number of the suction pipes is increased, and thus the fabrication costs are increased.

Furthermore, in the case of the dual type hermetic compressor, a plurality of suction pipes are connected to one accumulator, and coupled to a casing. This causes a processing and assembly of the accumulator and the casing to be difficult, thereby more increasing the fabrication costs.

Besides, while vibration generated from the compression part is transmitted through the plurality of suction pipes, the suction pipes resonate with one another, thus to increase the entire vibration of the compressor.

Technical Solution

Therefore, it is an object of the present invention to provide a hermetic compressor capable of reducing the number of components and assembly processes by commonly using a suction pipe in a dual type hermetic compressor having a plurality of cylinders, capable of reducing the fabrication costs by facilitating processing of an accumulator and a casing, and capable of preventing increase of vibration generated from a compression part.

It is another object of the present invention to provide a hermetic compressor capable of having an enhanced performance by optimizing a specification of a suction path for a refrigerant.

To achieve these and other advantages and in accordance with the purpose of the present invention, as embodied and broadly described herein, there is provided a hermetic compressor, comprising: a first cylinder having a first compression space, a first inlet communicated with the first compression space and directly connected to a suction pipe connected to a refrigeration cycle, and a bypass hole diverged from a middle part of the first inlet; a second cylinder having a second compression space, and a second inlet communicated with the second compression space and the first inlet; and a bearing plate disposed between the first and second cylinders to separate the first and second compression spaces from each other, and having a communication hole to communicate the first and second inlets with each other by being communicated with the bypass hole of the first cylinder.

Advantageous Effects

In the hermetic compressor, a plurality of cylinders are disposed at upper and lower sides, a communication path is formed to communicate inlets of the cylinders with each other, and a suction pipe connected to a system is coupled to only one inlet of one cylinder. Accordingly, when compared to the conventional case that a plurality of suction pipes are coupled to a plurality of cylinders, the number of components and processes can be more reduced, thereby reducing the fabrication costs. And, increase of vibration of the hermetic compressor due to resonation of the suction pipes can be prevented.

Furthermore, the hermetic compressor can have an enhanced performance by optimizing specifications of the suction pipe and its suction path.

BEST MODE FOR CARRYING OUT THE INVENTION

Reference will now be made in detail to the preferred embodiments of the present invention, examples of which are illustrated in the accompanying drawings.

Hereinafter, a hermetic compressor according to the present invention will be explained in more detail with reference to the attached drawings.

Figure 1:
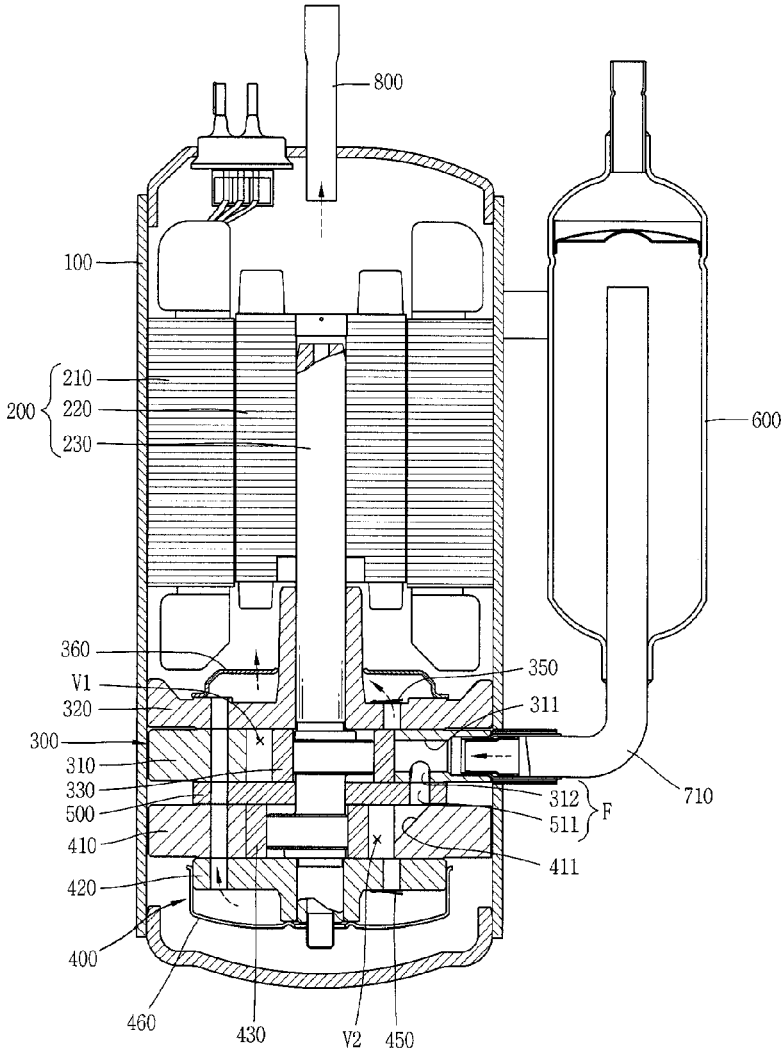
FIG. 1 is a longitudinal section view of a rotary compressor according to the present invention.
Figure 2:
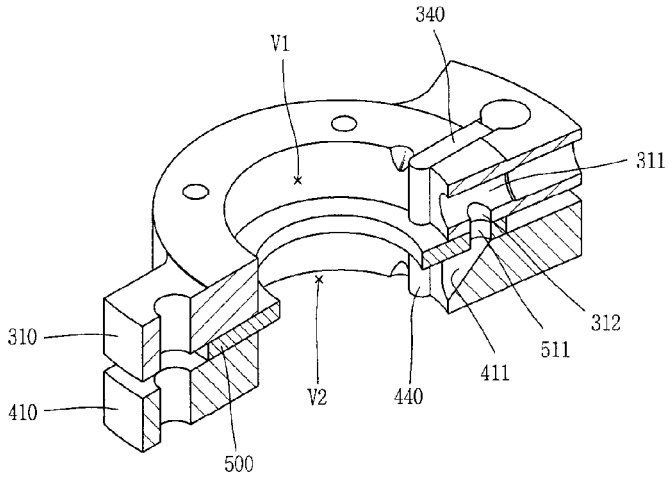
FIG. 2 is a perspective view showing a compression part of FIG. 1.
Figure 3:
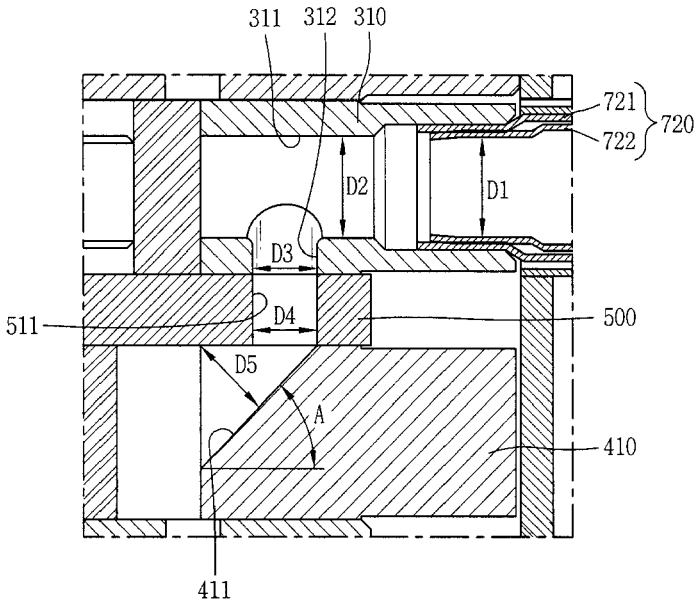
FIG. 3 is a longitudinal section view showing a suction path of the compression part of FIG. 1.

FIGS. 1 to 3 show a dual type rotary compressor as one example of a hermetic compressor according to the present invention, respectively.

As shown in FIG. 1, the dual type rotary compressor according to the present invention comprises a motor part 200 disposed at an upper hermetic space of a casing 100 for generating a driving force, and first and second compression parts 300 and 400 disposed at a lower hermetic space of the casing 100 for compressing a refrigerant by a rotational force generated from the motor part 200.

The first compression part 300 includes a first cylinder 310, an upper bearing plate (hereinafter, will be referred to as an upper bearing) 320, a first rolling piston 330, a first vane 340, a first discharge valve 350, and a first muffler 360.

The second compression part 400 includes a second cylinder 410, a lower bearing 420, a second rolling piston 430, a second vane 440, a second discharge valve 450, and a second muffler 460.

A middle bearing plate (hereinafter, will be referred to as a middle bearing) 500 for separating a first compression space (V1) of the first cylinder 310 from a second compression space (V2) of the second cylinder 410 is disposed between the first cylinder 310 and the second cylinder 410.

Here, one suction pipe 710 connected to an accumulator 600 is coupled to a lower part of the casing 100. And, to an upper end of the casing 100, coupled is one discharge pipe 800 through which a refrigerant discharged to the hermetic space from the first and second compression parts 300 and 400 is transmitted to a refrigeration system.

The suction pipe 710 is directly connected to a first inlet 311 of the first compression part 300 via a suction guide pipe 721 and a collar 722 that will be later explained. And, a second inlet 411 of the second compression part 400 is parallel-connected to the first inlet 311 of the first compression part 300 through a communication path (F).

Referring to FIG. 3, the suction pipe 710 is inserted into a suction guide pipe 721 insertion-coupled to the first inlet 311 of the first cylinder 310, and is coupled to the suction guide pipe 721 by welding. A collar 722 for adhering the suction guide pipe 721 to the first inlet 311 is forcibly-inserted into the suction guide pipe 721. A diameter (D2) of the first inlet 311 may be 0.9~1.3 times a diameter (D1) of the collar 722 or the suction pipe 710.

The communication path (F) is composed of a bypass hole 312 formed at an intermediate part of the first inlet 311, and a communication hole 511 formed at the middle bearing 500 so as to communicate the bypass hole 312 and the second inlet 411 with each other.

The first inlet 311 is penetratingly formed in a radial direction, the bypass hole 312 is penetratingly formed toward the middle bearing 500, and the through hole 511 is penetratingly formed in a shaft direction. And, the second inlet 411 is formed so as to be inclined toward an inner circumference of the second compression space (V2) of the second cylinder 410.

Referring to FIG. 3, the second inlet 411 may be formed to have an inclination angle (A) of about 0~90° based on a center line of the first inlet 311 in a longitudinal direction, i.e., a bottom surface of the second inlet 411, more preferably, of 30°~60° based on about 45°.

A diameter (D3) of the bypass hole 312 may be about 0.9 times the diameter (D2) of the first inlet 311, and a diameter (D4) of the communication hole 511 may be about 0.9 times the diameter (D3) of the bypass hole 312. And, a diameter (D5) of the second inlet 411 may be about 0.9 times the diameter (D4) of the communication hole 511.

An entrance edge of the bypass hole 312 may be inclined or rounded so that a refrigerant can be smoothly introduced into the communication hole 511 from the first inlet 311.

Preferably, the communication hole 511 is formed to have its volume corresponding to 1%~10% of a volume of the second compression space (V2) of the second cylinder 410, so as to more prevent a lowering of a performance of the compressor than in the conventional case that a plurality of suction pipes are coupled to a plurality of cylinders 310 and 410. More preferably, the communication hole 511 is formed to have its volume corresponding to 3%~7% of a volume of the second compression space (V2) of the second cylinder 410, so as to reduce an input applied to the motor of the compressor.

The second inlet 411 may be inclinably formed by cutting an inner circumferential edge of the second cylinder 410. And, although not shown, the second inlet 411 may be inclinably penetratingly formed at the second cylinder 410.

Unexplained reference numeral 210 denotes a stator, 220 denotes a rotor, and 230 denotes a rotation shaft.

The operation and effects of the dual type rotary compressor according to the present invention will be explained.

Once the rotor 220 is rotated as power is supplied to the stator 210 of the motor part 200, the rotation shaft 230 is rotated together with the rotor 220 thereby transmitting a rotation force of the motor part 200 to the first and second compression parts 300 and 400. While the first rolling piston 330 of the first compression part 300 and the second rolling piston 430 of the second compression part 400 perform an eccentric rotation with a phase difference of 180 in the first compression space (V1) and the second compression space (V2), respectively, they form a suction chamber together with the first vane 340 and the second vane 440. Accordingly, a refrigerant is sucked into the suction chamber.

Figure 4:
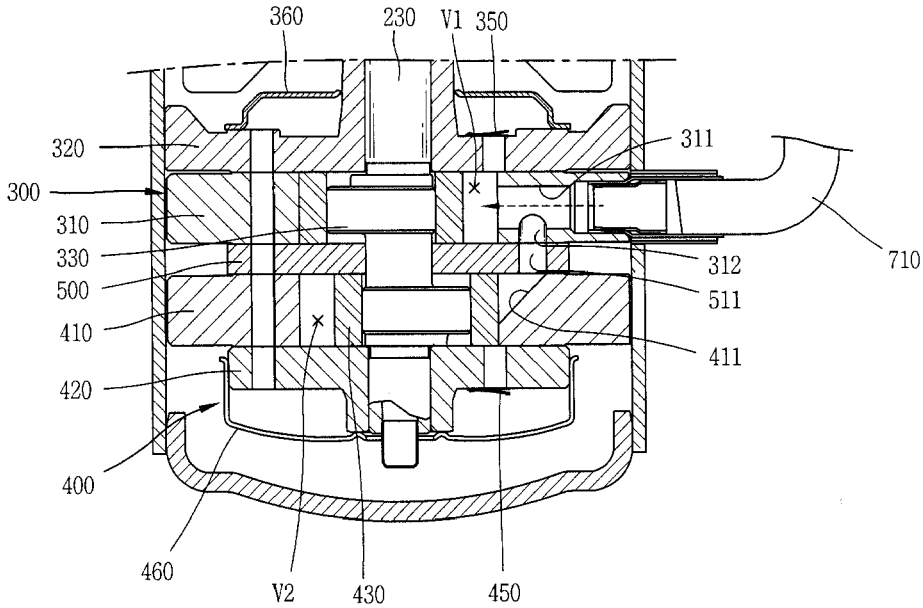
FIG. 4 is a longitudinal section view showing a process that a refrigerant is sucked into a first cylinder in FIG. 1.

Referring to FIG. 4, once a suction operation is started in the first compression space (V1), a refrigerant is introduced into the first inlet 311 via the accumulator and the suction pipe 710. Then, the refrigerant is sucked into the first compression space (V1) through the first inlet 311, and is compressed.

Figure 5:
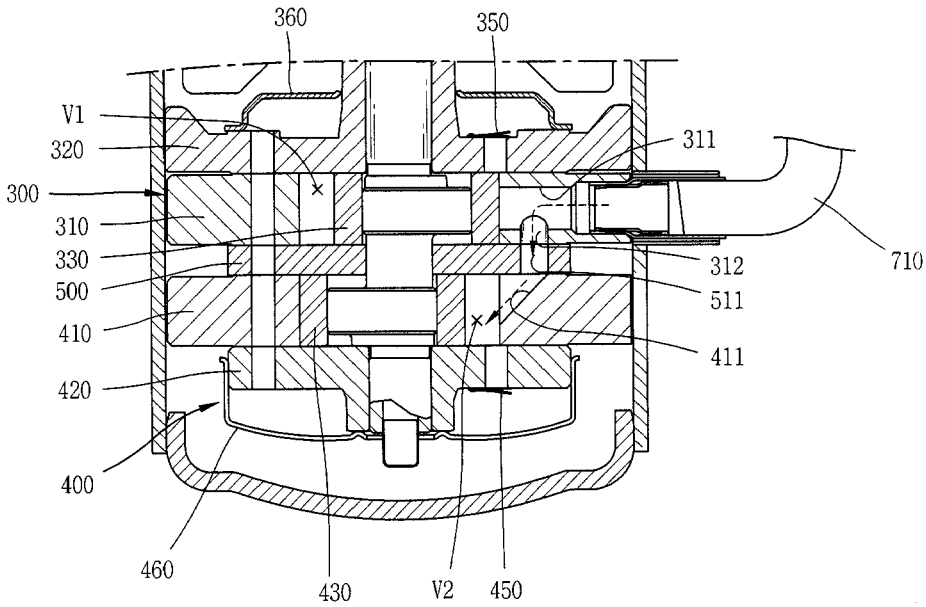
FIG. 5 is a longitudinal section view showing a process that a refrigerant is sucked into a second cylinder in FIG. 1.

Referring to FIG. 5, while a compression operation is performed in the first compression space (V1), a suction operation is performed at the second compression space (V2) of the second cylinder 410 having a phase difference of 180° from the first compression space (V1). As the second inlet 411 of the second cylinder 410 is communicated with the first inlet 311 of the first cylinder 310 through the communication hole (including the bypass hole) 511, a refrigerant sucked into the first inlet 311 via the suction pipe 710 is made to flow to the bypass hole 312 and the communication hole 511, thereby to be introduced into the second inlet 411. Then, the refrigerant is sucked into the second compression space (V2), and is compressed.

Under these configurations, a refrigerant sucked into one suction pipe 710 is alternately sucked into the first compression space (V1) and the second compression space (V2) through the communication path (F) between the first and second cylinders 310 and 410. This more reduces the number of components, and the number of processes for connecting the suction pipe 710 to the casing 100 and the accumulator 600 than in the conventional case that the plurality of suction pipes are connected to the plurality of cylinders 310 and 410. Accordingly, the entire fabrication costs can be reduced.

Furthermore, since vibration generated from the first and second compression parts 300 and 400 is transmitted to one suction pipe 710, vibration increase due to resonance of a plurality of suction pipes can be prevented.

Figure 6:
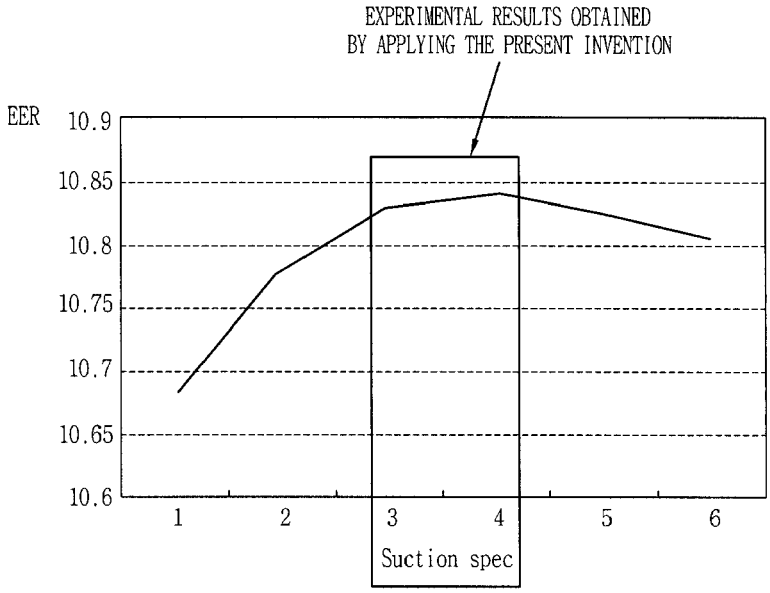
FIG. 6 is a graph showing each efficiency of the rotary compressor in the case that each component of the rotary compressor is within an optimum specification range, and is not within an optimum specification range.

FIG. 6 is a graph showing an experimental result of a performance of the hermetic compressor (EER) when diameters of the suction pipe 700, the first inlet 311, the bypass hole 312, the communication hole 511, the second inlet 411, etc. are within an optimum specification range, and when the inclination angle (A) of the second inlet 411 is within an optimum specification range.

Mode for the Invention

In the aforementioned embodiment, the suction pipe is directly connected to the first inlet. However, it is also possible that the suction pipe is directly connected to the second inlet, and the first inlet is connected to the second inlet by being diverged from the suction pipe.

Industrial Applicability

In the preferred embodiment, the first and second cylinders are arranged at upper and lower sides. However, the cylinders can be applied to two or more hermetic compressors.

And, the present invention can be applied to a variable capacity type compressor in which a valve is installed at a bypass hole or a communication hole, or a variable capacity type in which a bypass hole is formed at a second cylinder and a valve is installed at the bypass hole. Also, the present invention can be applied to a variable capacity type compressor in which a hermetic space separated from a casing is formed at a first vane or a second vane, and a suction pressure or a discharge pressure is selectively supplied to the hermetic space thereby to idle a corresponding compression chamber.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A hermetic compressor, comprising:

a first cylinder having a first compression space, a first inlet in communication with the first compression space and directly connected to a suction pipe connected to a refrigeration cycle, and a bypass hole that diverges from a middle part of the first inlet;

a second cylinder having a second compression space, and a second inlet in communication with the second compression space and the first inlet; and a bearing plate disposed between the first and second cylinders to separate the first and second compression spaces from each other, the bearing plate having a communication hole in communication with the bypass hole of the first cylinder to provide for communication between the first and second inlets, wherein a diameter D3 of the bypass hole of the first cylinder is greater than or equal to about 0.9 times a diameter D2 of the first inlet, a diameter D4 of the communication hole of the bearing plate is greater than or equal to about 0.9 times the diameter D3 of the bypass hole, and a diameter D5 of the second inlet is greater than or equal to about 0.9 times the diameter D4 of the communication hole, the diameter D2 of the first inlet is about 0.9 to 1.3 times a diameter D1 of a suction pipe, and wherein a volume of the communication hole corresponds to 1%-10% of a volume of the second compression space, and wherein the second inlet is formed on an inner circumferential edge of the second cylinder and has an inclination of about 30° to 60° with respect to the first inlet from an upper surface of the second cylinder which is connected to the communication hole to the inner circumferential edge of the second cylinder.

2. The hermetic compressor of claim 1, wherein the bypass hole and the communication hole are formed to be concentric with each other.

3. The hermetic compressor of claim 1, wherein the bypass hole and the communication hole are respectively formed to have a center line approximately perpendicular to the first inlet.

* * * * *